US011077569B2

(12) United States Patent
Provost et al.

(10) Patent No.: US 11,077,569 B2
(45) Date of Patent: Aug. 3, 2021

(54) SHAVING SYSTEMS

(71) Applicant: ShaveLogic, Inc., Dallas, TX (US)

(72) Inventors: Craig A. Provost, Newport Beach, CA (US); William E. Tucker, Plymouth, MA (US); John W. Griffin, Moultonborough, NH (US)

(73) Assignee: SHAVELOGIC, INC., Dallas, TX (US)

( * ) Notice: Subject to any disclaimer, the term of this patent is extended or adjusted under 35 U.S.C. 154(b) by 88 days.

(21) Appl. No.: 16/698,605

(22) Filed: Nov. 27, 2019

(65) Prior Publication Data

US 2020/0094428 A1 Mar. 26, 2020

Related U.S. Application Data

(63) Continuation of application No. 16/032,112, filed on Jul. 11, 2018, now Pat. No. 10,507,588, which is a continuation of application No. 15/298,457, filed on Oct. 20, 2016, now Pat. No. 10,052,776, which is a (Continued)

(51) Int. Cl.

| | |
|---|---|
| ***B26B 21/52*** | (2006.01) |
| ***B26B 21/22*** | (2006.01) |
| ***B26B 21/14*** | (2006.01) |
| ***B26B 21/40*** | (2006.01) |

(52) U.S. Cl.

CPC ..... *B26B 21/521* (2013.01); *B26B 21/14* (2013.01); *B26B 21/225* (2013.01); *B26B 21/4081* (2013.01); *Y10T 83/04* (2015.04)

(58) Field of Classification Search

CPC ..... B26B 21/521; B26B 21/225; B26B 21/14; B26B 21/4081; Y10T 83/04

See application file for complete search history.

(56) References Cited

U.S. PATENT DOCUMENTS 996,879 A * 7/1911 Odell ..... B26B 21/18 30/70
1,015,575 A * 1/1912 Meyer ..... B26B 21/225 30/527
1,074,615 A 10/1913 Folmer (Continued)

FOREIGN PATENT DOCUMENTS

CN 101612740 12/2009
EP 1245351 10/2002

(Continued)

OTHER PUBLICATIONS

European Patent Application No. 20171740.2, Extended European Search Report dated Sep. 18, 2020, 5 pages.

(Continued)

*Primary Examiner* — Sean M Michalski

(74) *Attorney, Agent, or Firm* — Leber IP Law; Celia H. Leber

(57) ABSTRACT

Shaving assemblies are disclosed that include a blade unit, an interface element configured to connect the blade unit to a handle, on which the blade unit is pivotably mounted, and a return element disposed between the blade unit and interface element. The return element serves as interface piece, connector and pivot all in one. Shaving systems including such shaving assemblies are also disclosed, as are methods of using such shaving systems.

23 Claims, 18 Drawing Sheets

Related U.S. Application Data continuation of application No. 13/929,340, filed on Jun. 27, 2013, now Pat. No. 9,486,930.

(60) Provisional application No. 61/706,523, filed on Sep. 27, 2012.

(56) References Cited

U.S. PATENT DOCUMENTS 1,105,575 A 7/1914 Miehle
1,299,096 A 4/1919 Ames Butler
3,593,416 A * 7/1971 Edson ..... B26B 21/14 30/50
3,709,517 A 1/1973 Wossner
3,768,348 A * 10/1973 Braun ..... B26B 19/16 83/13
3,938,247 A * 2/1976 Carbonell ..... B26B 21/225 30/47
4,094,063 A * 6/1978 Trotta ..... B26B 21/521 30/47
4,403,414 A 9/1983 Kiraly et al.
4,475,286 A * 10/1984 Saito ..... B26B 21/225 30/50
4,774,765 A * 10/1988 Ferraro ..... B26B 21/227 30/50
4,785,534 A * 11/1988 Lazarchik ..... B26B 21/225 30/50
4,834,760 A 5/1989 Richter, Jr.
4,838,564 A 6/1989 Jarvis
4,850,518 A 7/1989 Salmon et al.
4,970,784 A * 11/1990 Althaus ..... B26B 21/225 30/50
5,029,391 A 7/1991 Althaus et al.
5,074,042 A * 12/1991 Althaus ..... B26B 21/227 30/50
5,168,628 A * 12/1992 Mock ..... B05B 11/0005 30/125
5,219,468 A 6/1993 Olson
5,369,885 A * 12/1994 Ferraro ..... B26B 21/227 30/41
5,402,574 A * 4/1995 Milner ..... B26B 21/227 30/41.5
5,466,901 A 11/1995 Mochizuki
5,533,263 A 7/1996 Gilder
5,551,153 A * 9/1996 Simms ..... B26B 21/227 30/41
5,551,717 A 9/1996 De Courcey Milne
5,560,106 A 10/1996 Armbruster
5,645,603 A 7/1997 Peters
5,661,907 A 9/1997 Apprille
5,669,139 A * 9/1997 Oldroyd ..... B26B 21/222 30/47
5,678,316 A * 10/1997 Althaus ..... B26B 21/522 30/340
5,771,591 A * 6/1998 Armbruster ..... B26B 21/52 30/340
5,794,342 A * 8/1998 Davey ..... B26B 21/38 30/43.92
5,813,293 A 9/1998 Apprille, Jr. et al.
5,855,071 A 1/1999 Apprille, Jr. et al.
5,890,296 A 4/1999 Metcalf
6,014,918 A * 1/2000 Orloff ..... B26B 21/405 30/34.05
6,112,412 A 9/2000 Richard
6,122,826 A * 9/2000 Coffin ..... B26B 21/521 30/527
6,138,361 A 10/2000 Follo
6,145,201 A 11/2000 Andrews
6,161,287 A * 12/2000 Swanson ..... B26B 21/4025 30/50
6,182,366 B1 2/2001 Richard
6,216,345 B1 4/2001 Andrews
6,223,442 B1 * 5/2001 Pina ..... B26B 21/225 30/50
6,311,400 B1 * 11/2001 Hawes ..... B26B 21/225 30/50
6,357,118 B1 * 3/2002 Eichhorn ..... B26B 19/048 30/43.92
6,502,318 B1 * 1/2003 Gilder ..... B26B 21/225 30/530
6,557,265 B2 5/2003 Coffin
6,560,881 B2 5/2003 Coffin
6,612,040 B2 9/2003 Gilder
6,615,498 B1 9/2003 King et al.
6,637,113 B2 10/2003 Ikuta et al.
6,655,028 B2 12/2003 Coffin
6,772,523 B1 8/2004 Richard
6,807,739 B2 10/2004 Follo
6,851,190 B2 2/2005 Guimont et al.
6,854,188 B1 2/2005 Wonderley
6,880,253 B1 4/2005 Gyllerstrom
6,973,730 B2 12/2005 Tomassetti
6,990,740 B2 1/2006 Follo
6,996,908 B2 2/2006 Orloff et al.
6,997,446 B2 2/2006 Hall et al.
7,028,405 B2 * 4/2006 Paas ..... B26B 21/38 30/44
7,086,160 B2 8/2006 Coffin
7,100,284 B2 9/2006 King
7,103,976 B2 * 9/2006 Pennella ..... B26B 21/44 30/32
7,152,512 B1 * 12/2006 Prochaska ..... B26B 21/225 83/13
7,200,942 B2 4/2007 Richard
7,370,419 B2 5/2008 Coffin et al.
7,441,336 B2 10/2008 Hawes et al.
7,461,458 B2 12/2008 Peyser et al.
7,510,345 B2 3/2009 Kosh et al.
7,526,869 B2 * 5/2009 Blatter ..... B26B 21/225 30/532
7,574,809 B2 8/2009 Follo
7,669,511 B2 3/2010 King
7,784,504 B2 8/2010 Freed et al.
7,797,834 B2 9/2010 Steunenberg et al.
7,802,368 B2 9/2010 Coffin et al.
7,877,879 B2 2/2011 Nakasuka
7,913,393 B2 3/2011 Royle et al.
8,033,023 B2 10/2011 Johnson
8,096,054 B2 1/2012 Denkert et al.
8,166,661 B2 5/2012 King
8,205,343 B2 6/2012 Winter
8,205,344 B2 * 6/2012 Stevens ..... B26B 21/521 30/527
8,234,761 B2 8/2012 Gompert et al.
8,273,205 B2 * 9/2012 Murgida ..... B26B 21/225 156/242
8,307,552 B1 11/2012 Drouillard
8,359,751 B2 1/2013 Efthimiadis et al.
8,479,398 B2 7/2013 Coresh
8,484,852 B2 7/2013 King
8,499,459 B2 8/2013 Efthimiadis et al.
8,590,162 B2 * 11/2013 Park ..... B26B 21/225 30/50
8,640,342 B2 2/2014 Murgida
8,732,955 B2 5/2014 Howell et al.
8,746,223 B2 6/2014 Jones
8,769,825 B2 7/2014 Howell et al.
8,789,282 B2 7/2014 Wilson et al.
8,793,880 B2 8/2014 Taub et al.
8,844,145 B2 9/2014 Psimadas et al.
8,869,781 B2 10/2014 Jones
8,967,130 B2 3/2015 Victor et al.
9,283,685 B2 3/2016 Griffin et al.
9,475,202 B2 10/2016 Griffin et al.
9,486,930 B2 11/2016 Provost et al.
9,579,809 B2 2/2017 Hawes
9,630,331 B2 4/2017 Griffin et al.
9,676,108 B2 6/2017 Beugels et al.
9,694,503 B2 7/2017 Papadopoulos-Papageorgis et al.
9,701,034 B2 7/2017 Papadopoulos-Papageorgis et al.
9,707,688 B2 7/2017 Giannopoulos et al.
9,757,870 B2 9/2017 Giannopoulos et al.

(56) References Cited

U.S. PATENT DOCUMENTS

| | | | | |
|---|---|---|---|---|
| 9,902,077 | B2 | 2/2018 | Park et al. | |
| 2002/0059729 | A1* | 5/2002 | Ikuta | B26B 19/04 30/43.91 |
| 2002/0138992 | A1* | 10/2002 | Richard | B26B 21/225 30/527 |
| 2002/0157255 | A1* | 10/2002 | Coffin | B26B 21/44 30/41 |
| 2003/0046819 | A1 | 3/2003 | Ferraro | |
| 2003/0154603 | A1* | 8/2003 | Guimont | B26B 21/44 30/34.05 |
| 2003/0200659 | A1* | 10/2003 | Coffin | B26B 21/44 30/47 |
| 2003/0200660 | A1* | 10/2003 | Pennella | B26B 21/44 30/47 |
| 2003/0205858 | A1* | 11/2003 | Hall | A61C 17/3418 267/154 |
| 2004/0010918 | A1* | 1/2004 | Orloff | B26B 21/44 30/41 |
| 2004/0177519 | A1* | 9/2004 | Tomassetti | B26B 21/446 30/527 |
| 2005/0039338 | A1 | 2/2005 | King | |
| 2005/0207837 | A1 | 9/2005 | Kosh et al. | |
| 2005/0278954 | A1* | 12/2005 | Orloff | B26B 21/44 30/32 |
| 2006/0037197 | A1* | 2/2006 | Hawes | B26B 21/44 30/45 |
| 2006/0080837 | A1* | 4/2006 | Johnson | B26B 21/44 30/50 |
| 2006/0283025 | A1* | 12/2006 | Follo | B26B 21/225 30/527 |
| 2007/0151106 | A1* | 7/2007 | Steunenberg | B26B 21/38 30/50 |
| 2007/0204932 | A1* | 9/2007 | Freed | F16L 37/47 141/352 |
| 2007/0289139 | A1* | 12/2007 | Peyser | B26B 21/225 30/47 |
| 2008/0155831 | A1* | 7/2008 | Royle | B26B 21/38 30/34.1 |
| 2008/0189964 | A1 | 8/2008 | Bozikis et al. | |
| 2008/0196251 | A1 | 8/2008 | Royle | |
| 2009/0000126 | A1* | 1/2009 | Kraus | B26B 19/046 30/34.1 |
| 2009/0038167 | A1 | 2/2009 | Peyser | |
| 2009/0235539 | A1 | 9/2009 | Wonderley | |
| 2010/0011583 | A1* | 1/2010 | Efthimiadis | B26B 21/222 30/34.1 |
| 2010/0083505 | A1* | 4/2010 | Royle | B26B 21/225 30/50 |
| 2011/0017387 | A1 | 1/2011 | Murgida | |
| 2011/0138586 | A1* | 6/2011 | Gompert | F16B 45/02 24/599.4 |
| 2011/0192031 | A1* | 8/2011 | Coresh | B26B 21/225 30/34.2 |
| 2012/0060382 | A1* | 3/2012 | Beugels | B26B 19/048 30/527 |
| 2012/0073554 | A1* | 3/2012 | Victor | F41B 7/08 124/16 |
| 2012/0124840 | A1* | 5/2012 | Iaccarino | B26B 21/225 30/50 |
| 2012/0210586 | A1* | 8/2012 | Lelieveld | B26B 19/04 30/527 |
| 2013/0025578 | A1* | 1/2013 | Jones | F41B 5/1469 124/35.2 |
| 2013/0081289 | A1* | 4/2013 | Wain | B26B 21/52 30/527 |
| 2013/0174821 | A1 | 7/2013 | Jones | |
| 2014/0083265 | A1* | 3/2014 | Provost | B26B 21/14 83/13 |
| 2014/0109735 | A1* | 4/2014 | Shepperson | B26B 21/521 83/13 |
| 2014/0165800 | A1 | 6/2014 | Griffin | |
| 2015/0306777 | A1 | 1/2015 | Georgakis et al. | |
| 2015/0158192 | A1 | 6/2015 | Tucker et al. | |

FOREIGN PATENT DOCUMENTS

| | | |
|---|---|---|
| EP | 1488894 | 12/2004 |
| EP | 2123410 | 11/2009 |
| GB | 143536 | 3/1921 |
| GB | 1460732 | 1/1977 |
| GB | 2030909 | 4/1980 |
| WO | 2006127435 | 11/2006 |
| WO | 2010022192 | 2/2010 |

OTHER PUBLICATIONS

European Patent Application No. 13840539, Search Report dated Apr. 25, 2016, 7 pages.

International Search Report—Corresponding PCT Application No. PCT/US2013/052095, dated Oct. 15, 2013, 4 pages.

European Patent Application No. 18195160.9, Extended European Search Report dated Dec. 18, 2018, 10 pages.

Written Opinion—Corresponding PCT Application No. PCT/US2013/052095, dated Oct. 15, 2013, 8 pages.

* cited by examiner

SHAVING SYSTEMS

RELATED APPLICATIONS

This application is a continuation application of U.S. patent application Ser. No. 16/032,112, filed Jul. 11, 2018, which is a continuation application of U.S. patent application Ser. No. 15/298,457, filed Oct. 20, 2016, now U.S. Pat. No. 10,052,776, issued Aug. 21, 2018, which is a continuation of U.S. patent application Ser. No. 13/929,340, filed Jun. 27, 2013, now U.S. Pat. No. 9,486,930, issued Nov. 8, 2016, which claims priority of U.S. Provisional Application Ser. No. 61/706,523, filed on Sep. 27, 2012. The complete disclosure of these applications are hereby incorporated by reference herein.

BACKGROUND

The invention relates to shaving systems having handles and replaceable blade units. Shaving systems often consist of a handle and a replaceable blade unit in which one or more blades are mounted in a plastic housing. After the blades in a blade unit have become dull from use, the blade unit is discarded and replaced on the handle with a new blade unit. Such systems often include a pivoting attachment between the blade unit and handle, which includes a pusher and follower configured to provide resistance during shaving and return the blade unit to a "rest" position when it is not in contact with the user's skin.

SUMMARY

In general, the present disclosure pertains to shaving systems and to replaceable shaving assemblies for use in such systems. The systems include a flexible return element, e.g., of an elastomeric material, which provides the resistance and return force that are often provided by a pusher and follower mechanism in prior art shaving systems.

In one aspect, the invention features a replaceable shaving assembly that includes a blade unit and an interface element configured to removably connect the blade unit to a handle, on which the blade unit is pivotably mounted. The interface element includes spaced apart rigid portions connected by a flexible return element, the return element providing a pivoting connection between the blade element and handle.

Some implementations include one or more of the following features. A handle interface element configured to receive the handle may extend from one of the rigid portions, and a blade unit interface element configured to be mounted on the blade unit may extend from the other rigid portion. The return element may comprise two spaced apart elastomeric members that extend in a direction generally perpendicular to a longitudinal axis of the blade unit, and each of the elastomeric members may connect a pair of the spaced apart rigid portions. The return element may be configured to bias the blade unit towards a rest position with respect to a pivot axis that is generally parallel to a long axis of the blade unit, and is preferably pretensioned. The return element may be formed of an elastomeric material, e.g., a thermoplastic elastomer or thermoplastic urethane. The return element is generally molded onto the interface elements, e.g., by an overmolding process. In some cases, the return element includes two generally H-shaped portions. The rigid portions include corresponding protrusions, which extend toward each other and are embedded in the return element. In some cases, anchoring areas are provided in the protrusions, e.g., holes into which the elastomeric material of the return element can flow during overmolding.

In another aspect, the invention features a shaving system that includes a handle having a distal end and a proximal end, and a shaving assembly, mounted on the distal end of the handle, the shaving assembly including an interface element configured to connect the blade unit to the handle, and a blade unit that is pivotably mounted on the interface element. The interface element includes a pair of spaced apart rigid portions connected by a flexible return element, the return element providing a pivoting connection between the blade element and handle.

Some implementations of this aspect can include any one or more of the features discussed above with regard to the shaving assembly. In some cases, the shaving assembly is removably mounted on the handle via the interface element and is replaceable.

The invention also features methods of shaving. For example, in one aspect the invention features a method of shaving comprising contacting the skin with the blade unit of a shaving system comprising a handle having a distal end and a proximal end, and a replaceable shaving assembly that includes a blade unit, and an interface element configured to removeably connect the blade unit to a handle, on which the blade unit is pivotably mounted, the interface element comprising a pair of spaced apart rigid portions connected by an elastomeric element, the elastomeric element providing a pivoting connection between the blade element and handle.

DETAILED DESCRIPTION

The present disclosure relates generally to consumer products and, in particular, to shaving systems with interchangeable blade units. In one embodiment, the present disclosure features a reusable consumer product system having an interchangeable pivoting blade unit, which includes a return element. For example, the present disclosure could include a system having a blade unit attached to a handle in part by elongated elastomeric members that provide the resistance and return force usually supplied by a pusher/follower assembly.

Figure 1:
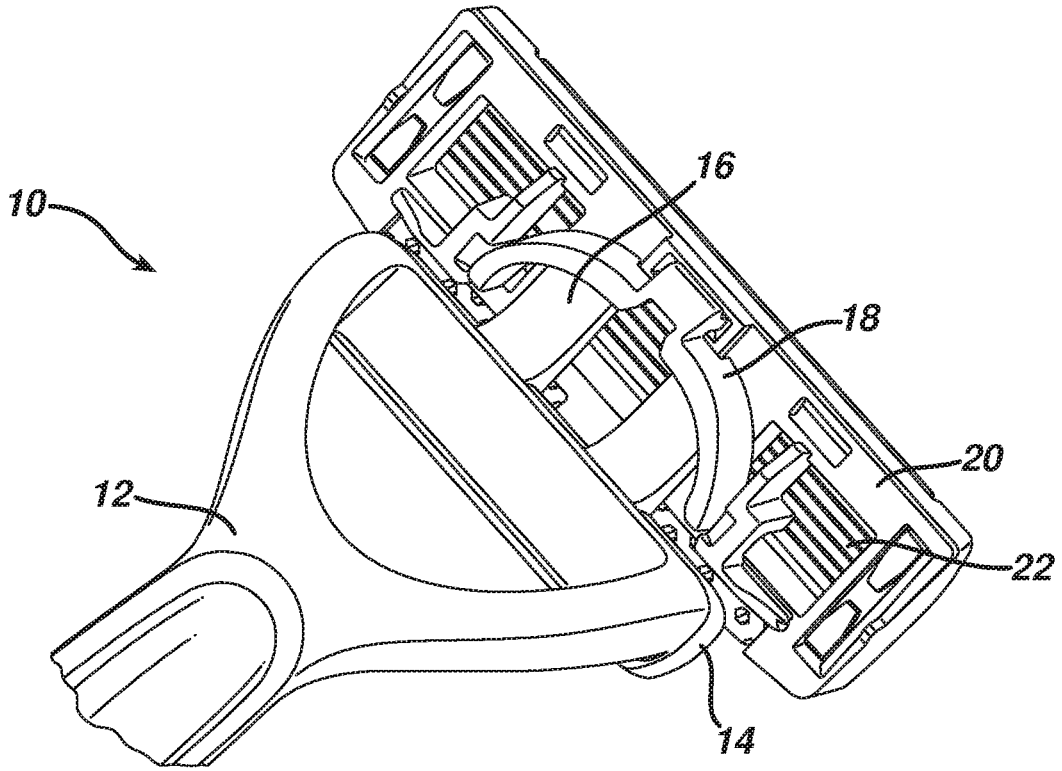
FIG. 1 is a perspective view of an assembled shaving system according to one embodiment.
Figure 2:
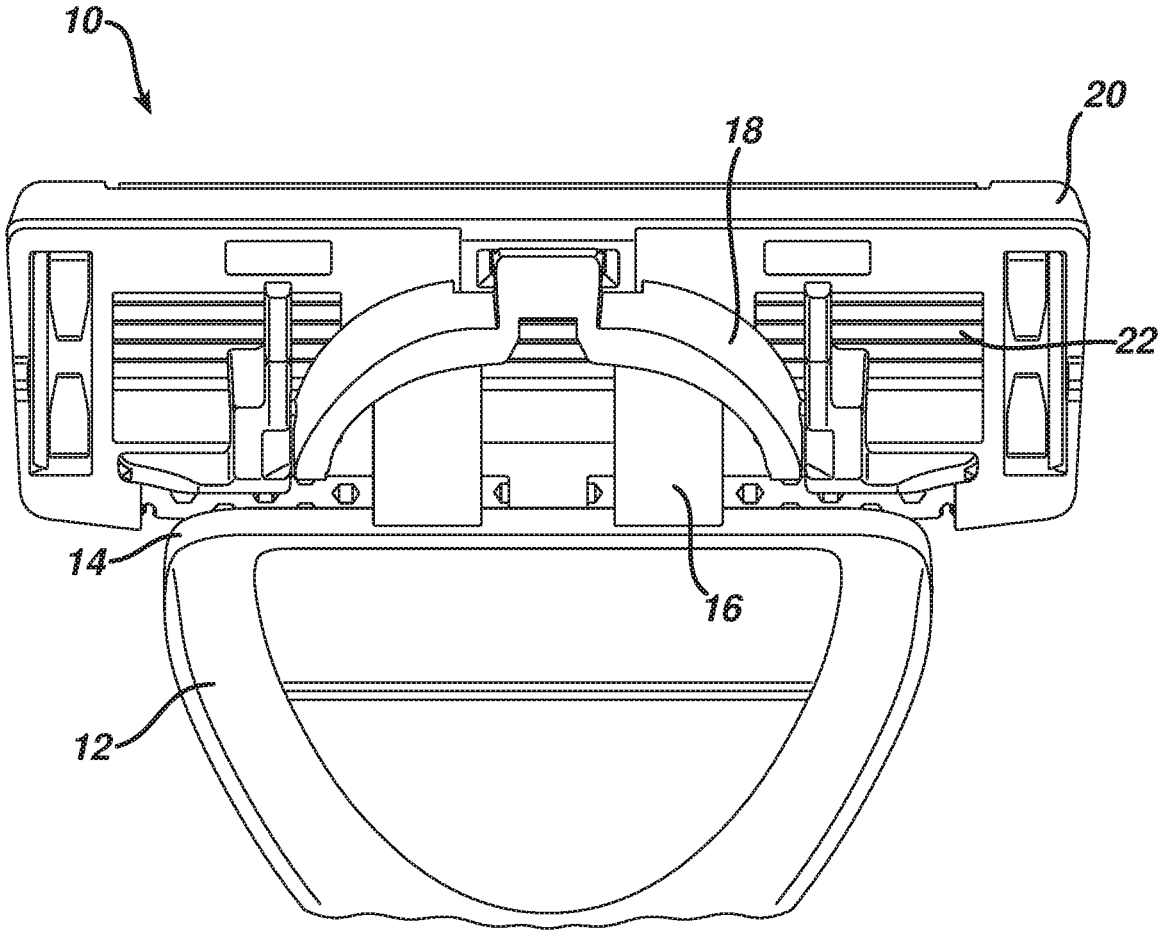
FIG. 2 is a rear plan view of the assembled shaving system.
Figure 3:
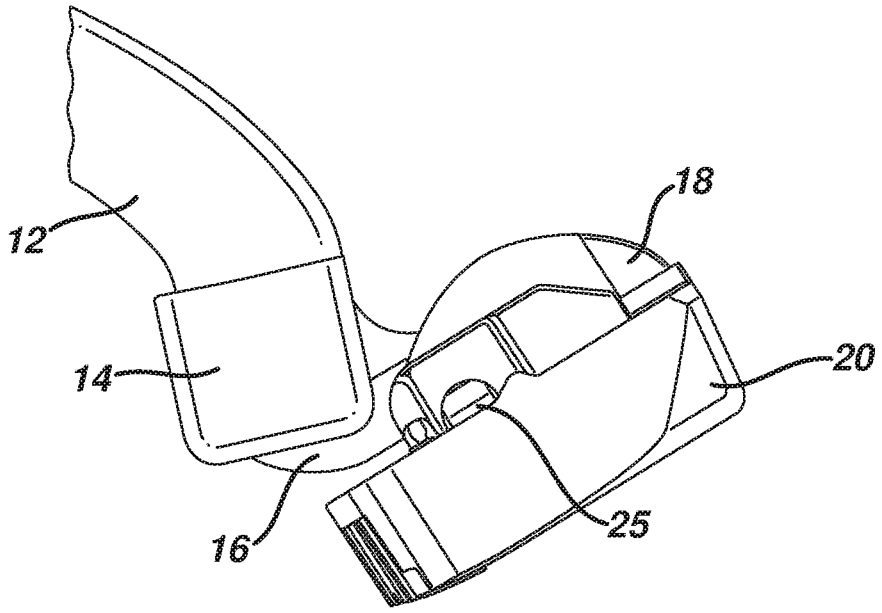
FIG. 3 is a side plan view of the assembled shaving system.
Figure 13:
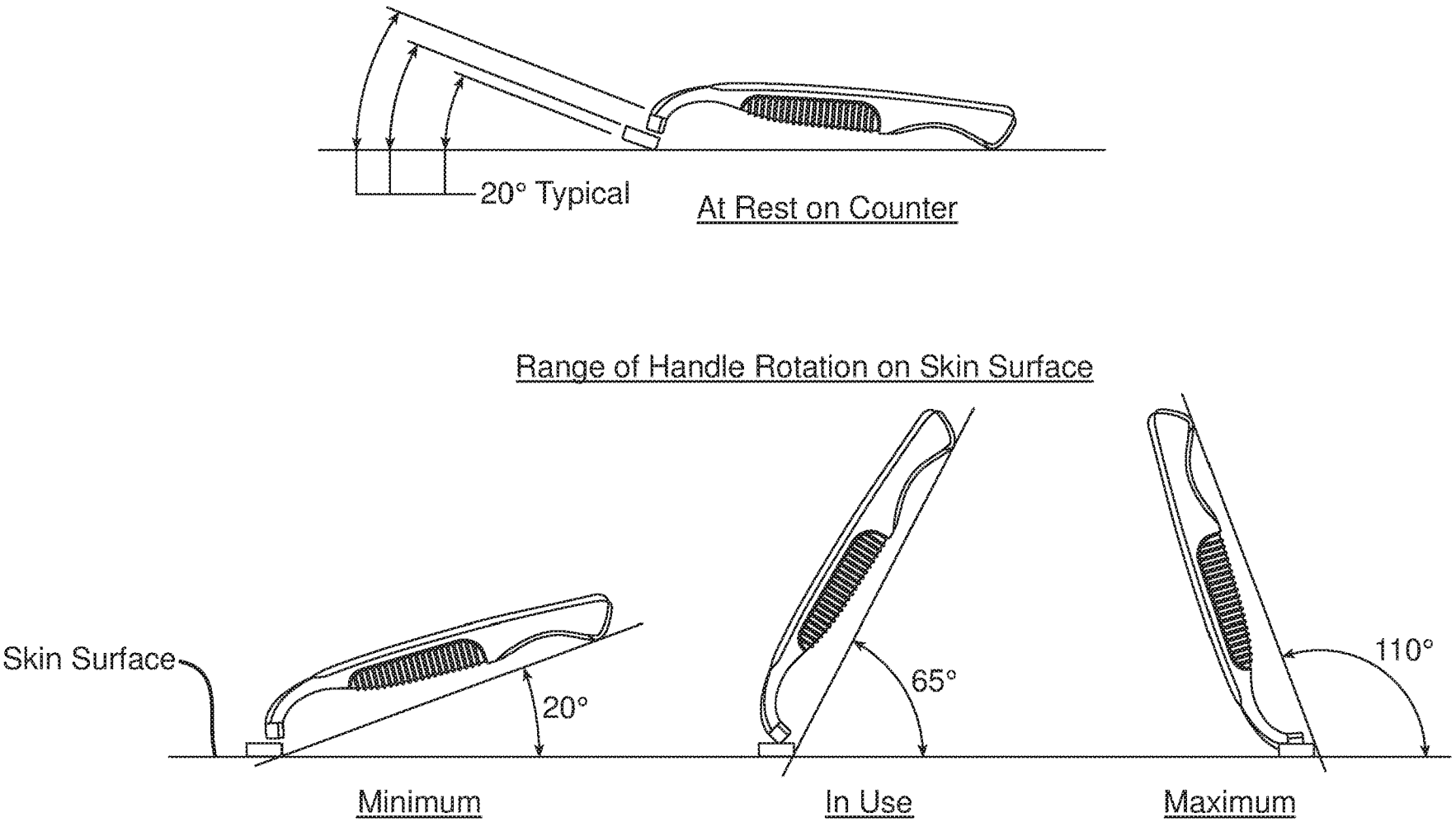
FIG. 13 is a series of diagrammatic views illustrating how the angle of the blade unit with respect to the handle is measured.

FIG. 1 shows a shaving system 10 that includes a handle 12, a handle interface element 14, a return element 16, a blade unit interface element 18 and a blade unit 20 which includes a plurality of blades 22. Pivoting of the blade unit 20 is about an axis that is generally parallel to the long axis of the blade unit and is generally positioned to allow the blade unit 20 to follow the contours of a user's skin during shaving. Generally, the handle interface element 14, the return element 16, the blade unit interface element 18 and blade unit 20 are sold to the consumer as an integrated replaceable shaving assembly. Preferably the angle of blade unit 20 with respect to handle 12 is 65° but can range from approximately 15° to 105° (FIG. 13).

Figure 4:
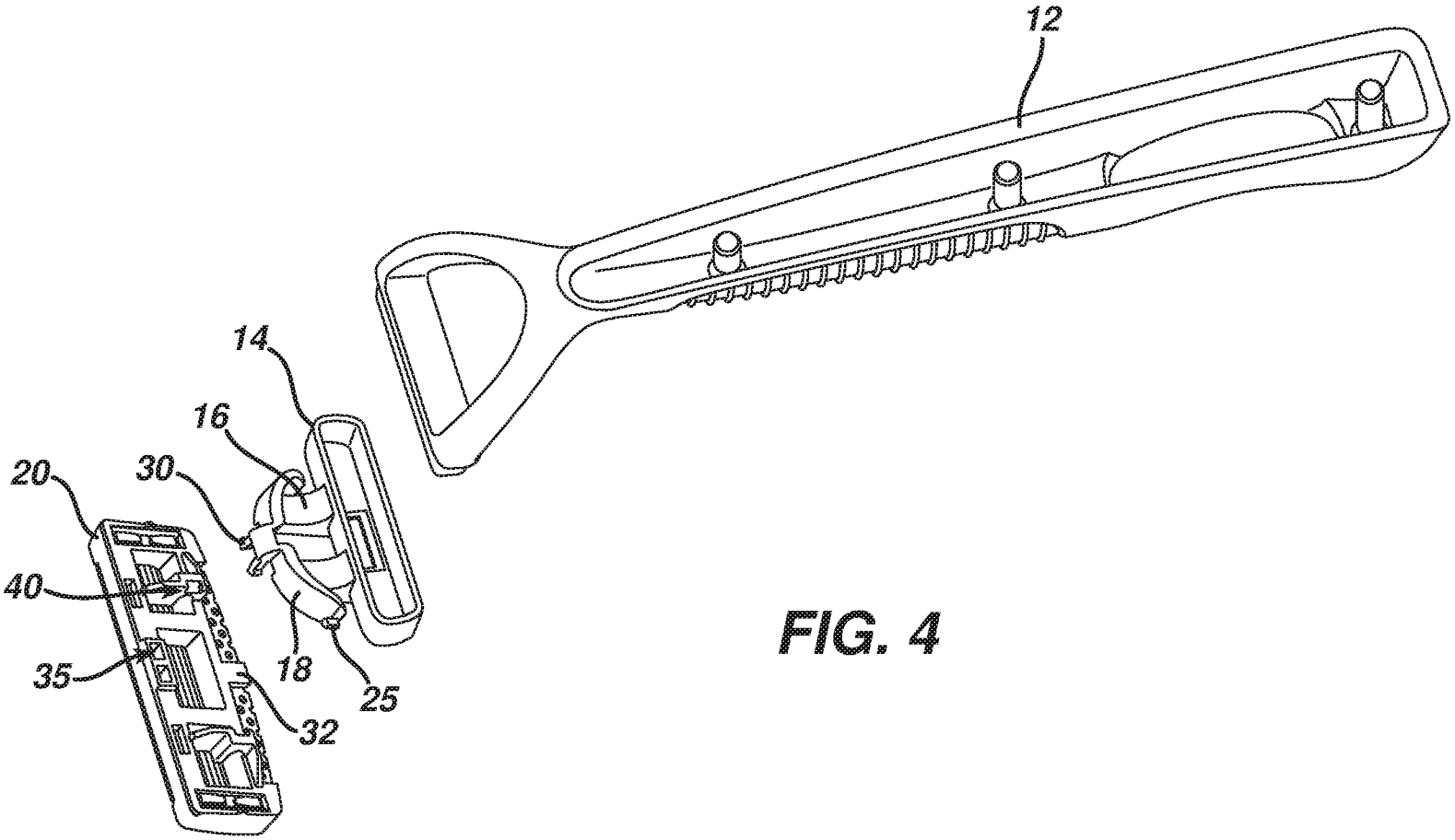
FIG. 4 is an exploded view of the shaving system.

Referring to FIG. 4, the blade unit 20 is mounted on blade unit interface element 18 by the positioning of a pair of fingers 30 which extend from the blade unit interface element 18 into receiving bores 35 on the blade unit 20. The receiving bores 35 may be molded integrally with the blade unit 20. In addition, the blade unit interface element 18 includes tabs 25A and 25B (FIG. 6) that serve as complementary attachment points for the blade unit 20. The blade unit pivot stop 32 is integrally formed with the blade unit 20 and extends generally perpendicular to the long axis of the blade unit 20. The blade unit pivot stop 32 limits the pivoting of the blade unit 20.

Figure 5:
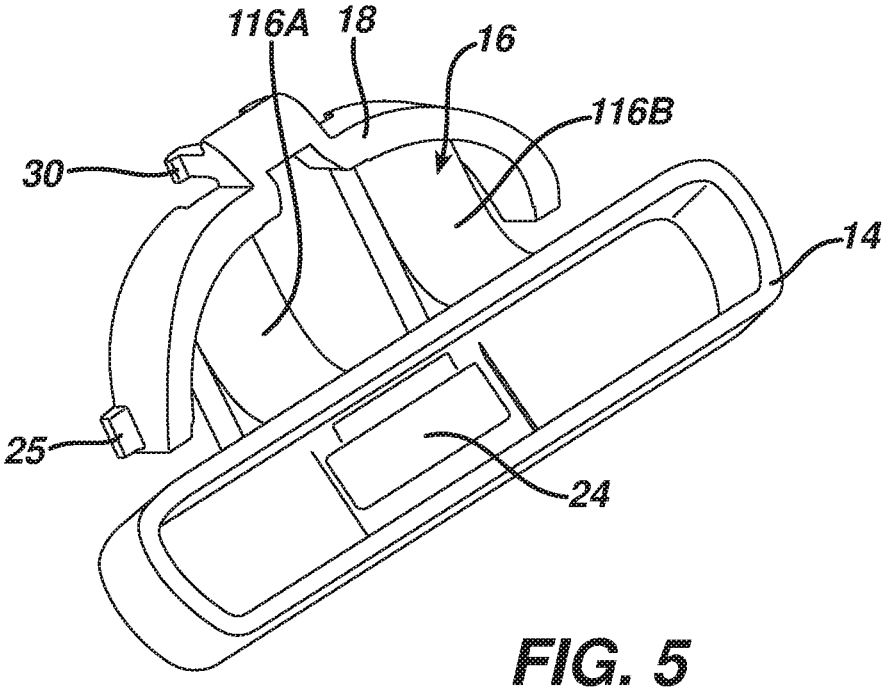
FIG. 5 is a view of the handle interface element, the return element, and the blade unit interface element of the shaving system shown in FIG. 1.
Figure 5A:
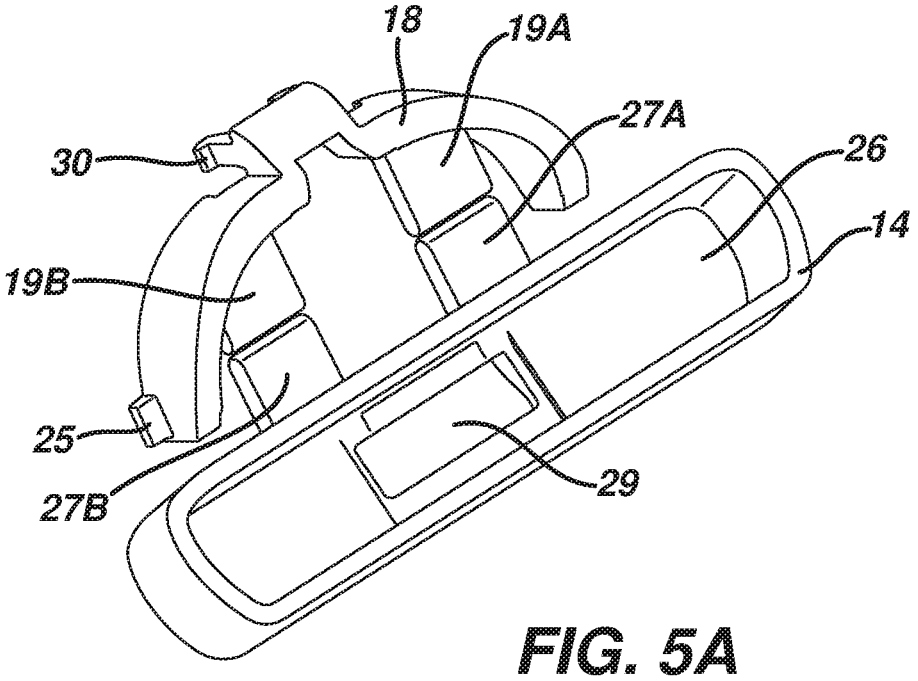
FIG. 5A is a view of the handle interface element and the blade interface element.

Referring to FIG. 5A, the handle interface element 14 is made up of a handle interface portion 26 and two protrusions 27A and 27B. The protrusions 27A and 27B extend generally perpendicular to the long axis of the handle interface portion 26. The blade unit interface element 18 has two protrusions 19A and 19B that correspond to and align in a similar plane as the two protrusions 27A and 27B on the handle interface portion 26.

Figure 6:
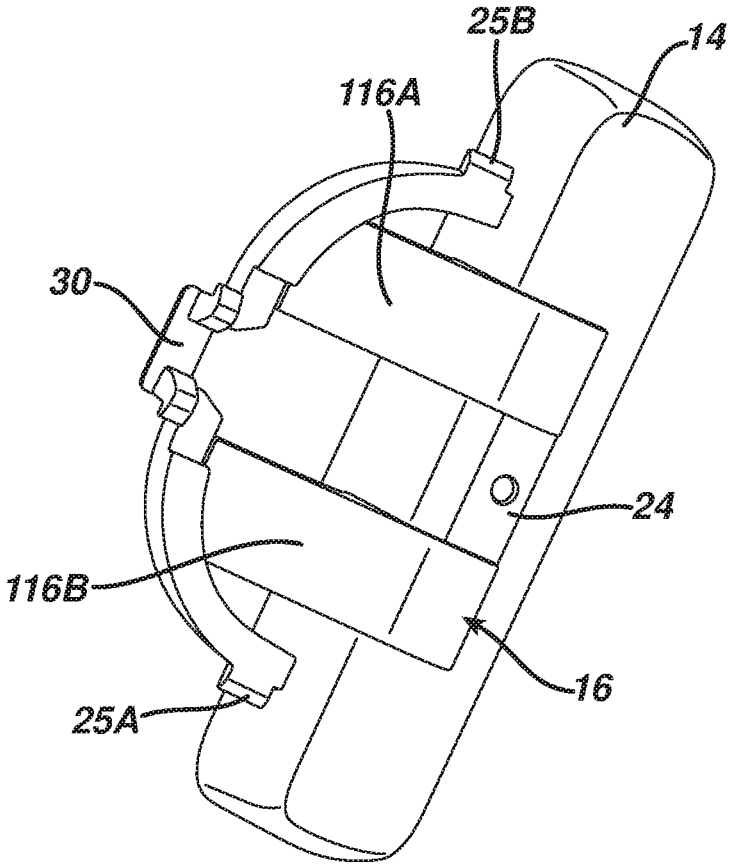
FIG. 6 is a perspective view of the handle interface element, the return element, and the blade unit interface element.
Figure 7:
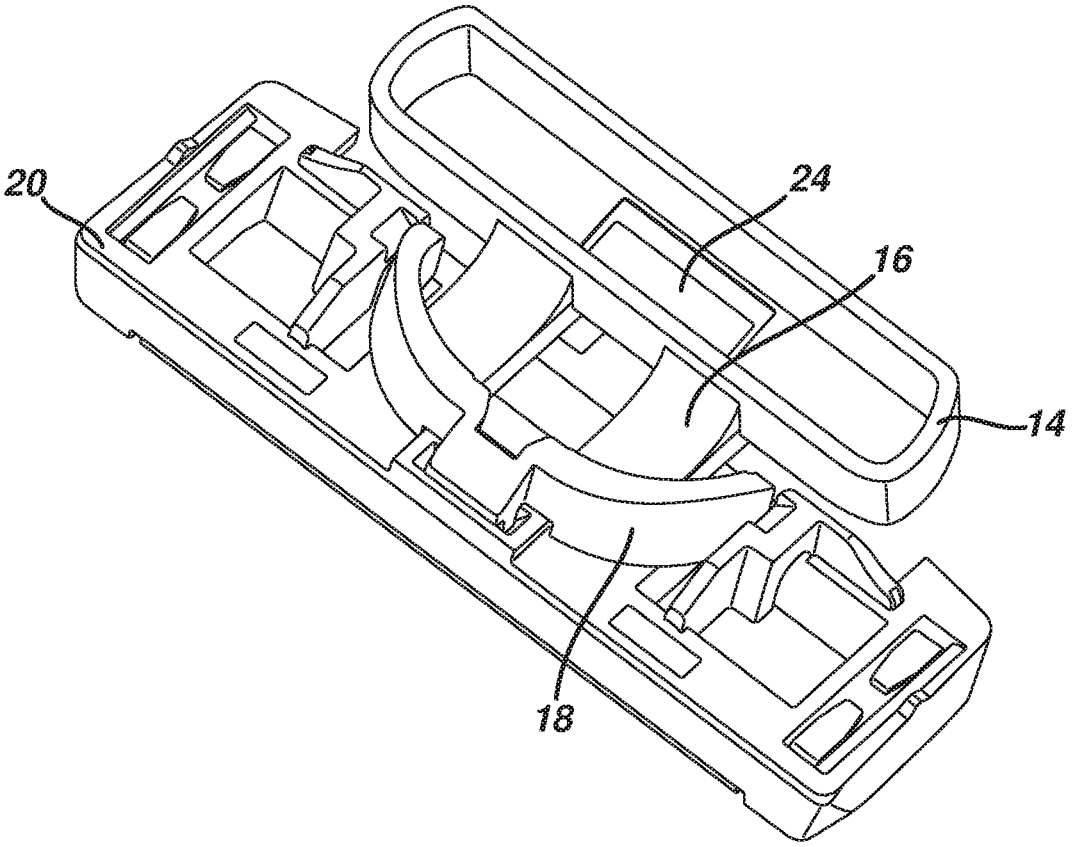
FIGS. 7 and 8 are alternate views of the handle interface element, the return element, the blade unit interface element, and the blade unit housing.

Referring to FIGS. 5-7, the handle interface element 14 is flexibly joined to the blade unit interface element 18 by the return element 16. The return element 16 consists of a pair of elongated elastomeric members 116A and 116B, which connect protrusions 19A and 19B to protrusions 27A and 27B. The return element 16 serves as a pivot and provides resistance during shaving, limiting the free pivoting of the blade unit about the pivot axis described above. In addition, the return element 16 provides a return force that biases the blade unit 16 towards its rest position, in the same manner that resistance and return force are typically provided by a pusher/follower assembly.

Figure 8:
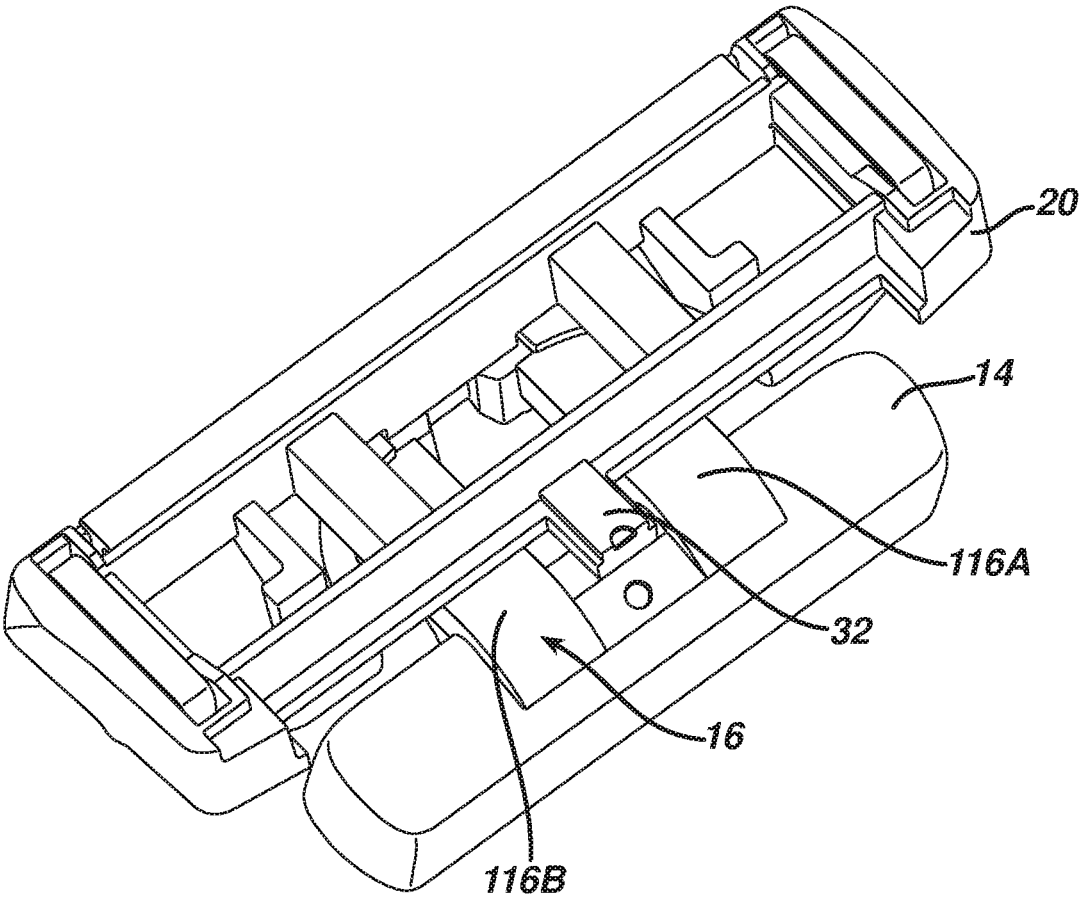
Figure 9:
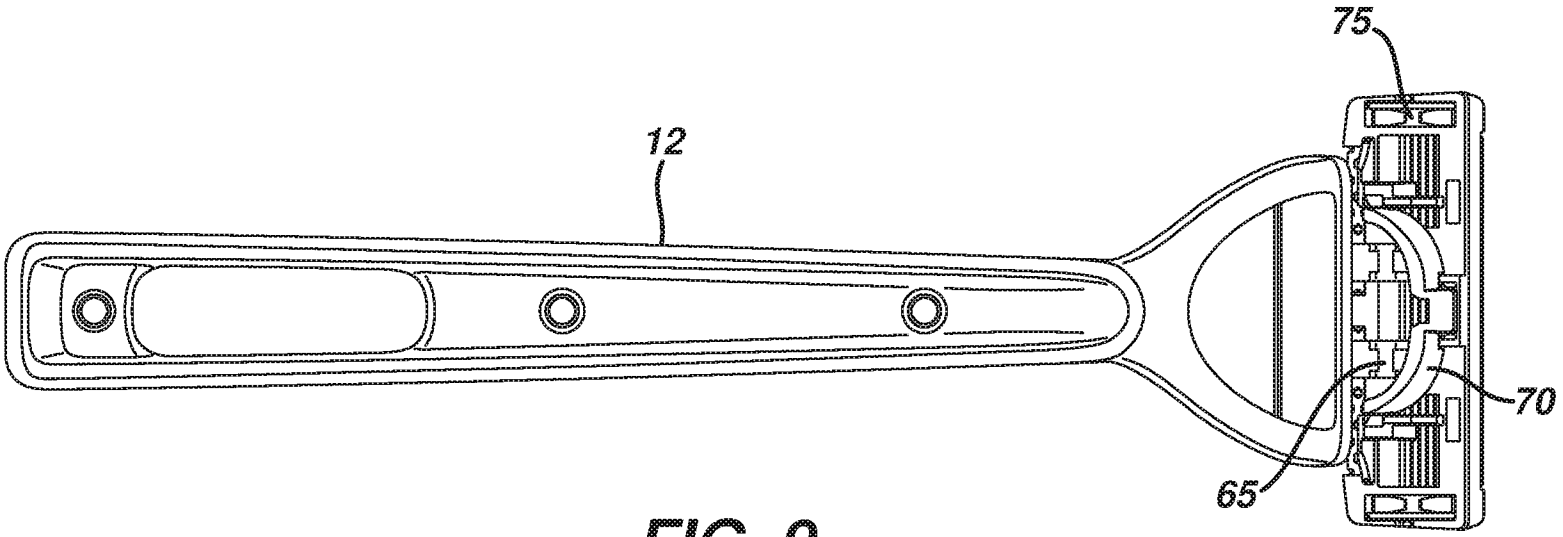
FIG. 9 is a perspective view of a shaving system according to an alternate embodiment.
Figure 10:
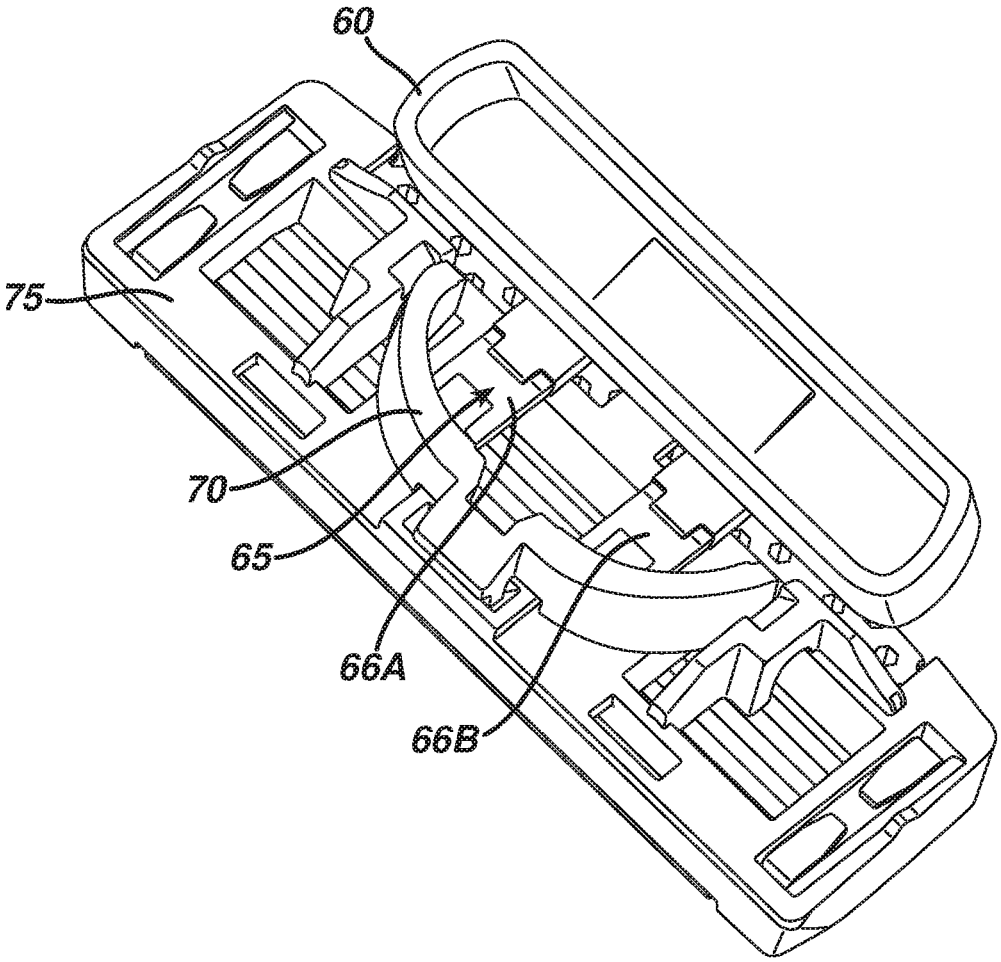
FIGS. 10 and 10A are enlarged perspective views of the handle interface element, the return element, the blade unit interface element, and the blade unit of the shaving system shown in FIG. 9.
Figure 10A:
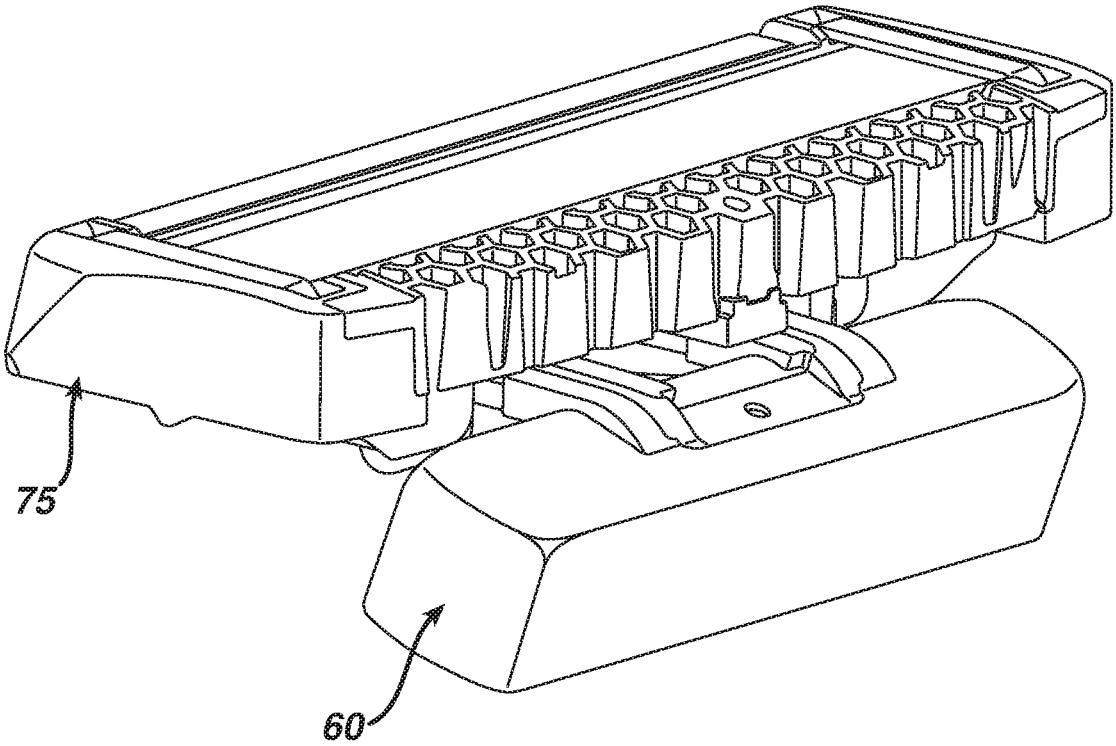
Figure 11:
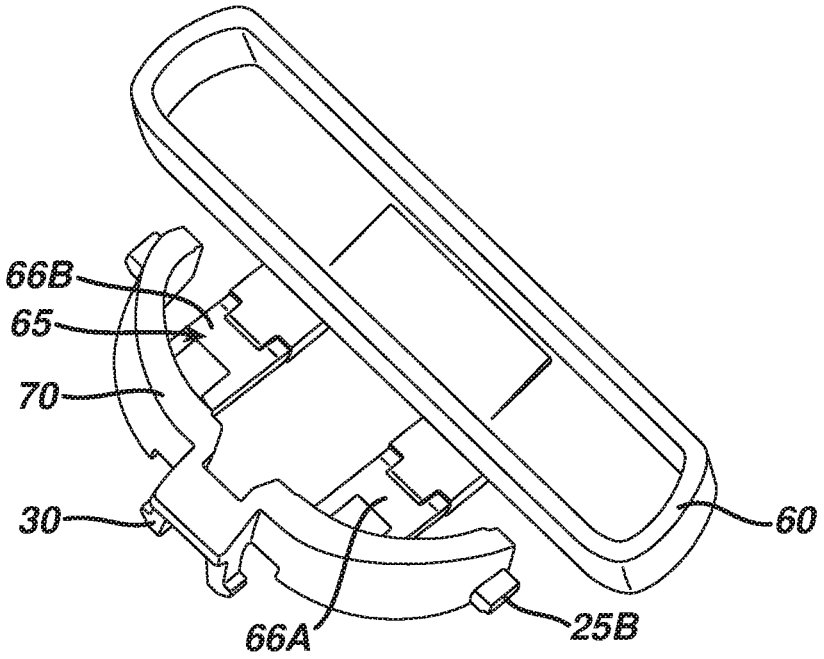
FIG. 11 is a perspective view of the handle interface element, the return element, and the blade unit interface element.
Figure 11A:
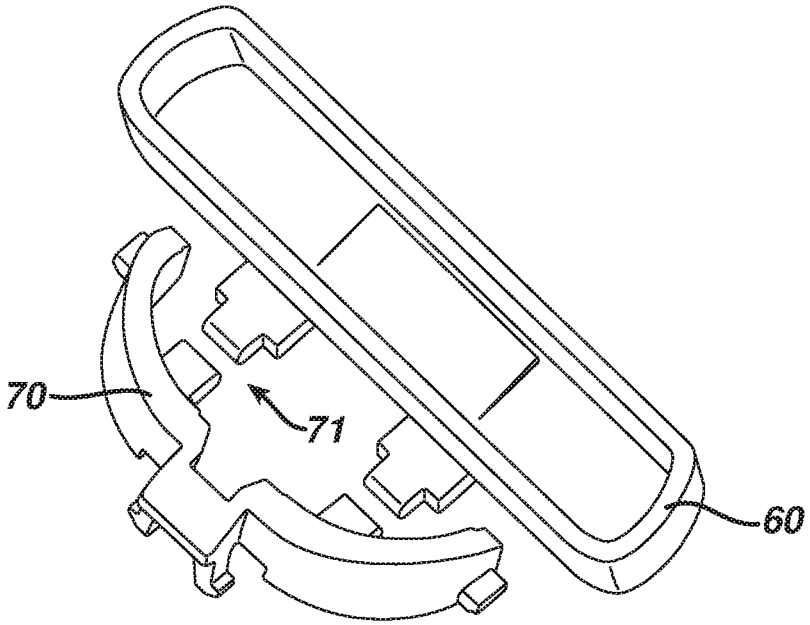
FIG. 11A is a view of the handle interface element and blade interface element.

Referring to FIG. 8, the elongated members 116A and 116B are pretensioned when the blade unit is in its at rest position by bending of the elastomer over the blade unit. This pretensioning is the result of the angle at which the components are molded and the geometry of the return element, which are selected so that when the interface element is assembled onto the blade unit the return element is pretensioned. Pretensioning provides a resistance force so that a load is applied as soon as the user starts shaving, balancing the blade unit.

Figure 5B:
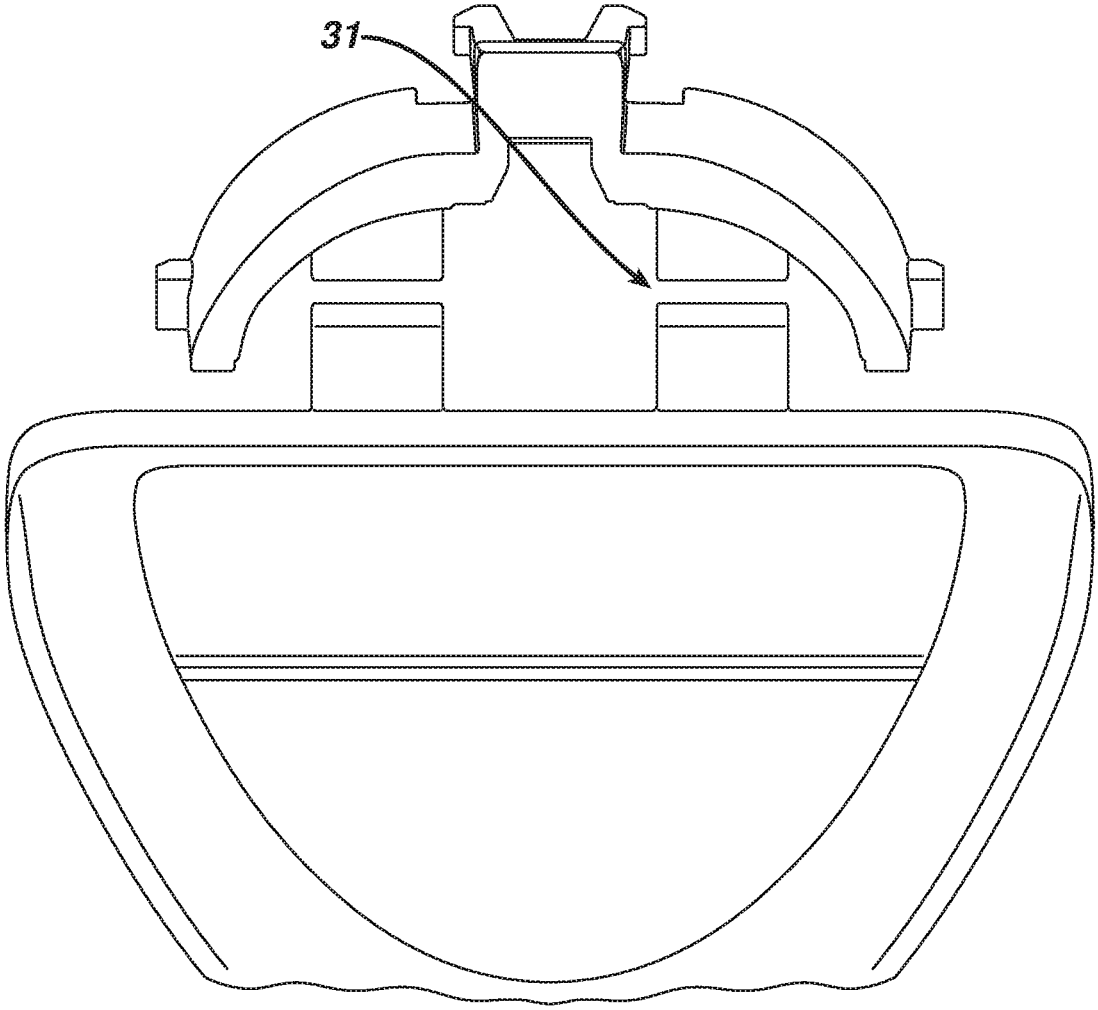
FIG. 5B is a perspective view of the handle interface element, blade interface element, and handle, with the return element omitted to show the spacing between the handle interface element and blade interface element.

The return element 16 may be integrally molded with the handle interface element 14 and the blade unit interface element 18, e.g., by co-molding the elastomer with the rigid plastic(s). It is noted that the term "co-molding," as used herein, includes transfer molding and other techniques suitable for molding two or more different materials into a single part. Molding is facilitated by an opening 29 in the handle interface element 14 through which the elastomeric material can be injected so that it molds around the protrusions 27A and 27B shown in FIG. 5A. Preferably, during co-molding, there is a gap 31 (FIG. 5B) between the blade unit interface element 18 and the handle interface element 14. This gap allows the two interface elements to be flexibly joined by the elastomer. In some implementations the gap is from about 1 mm to 15 mm, preferably about 3 to 10 mm. Molding the return element 16 in this manner results in an elastomeric anchor 24, which fills the opening 29. Thus, molding may be a three-shot process in which the interface elements are molded first in two separate shots, followed by the elastomer.

The return element 16 can be formed, for example, from synthetic or natural rubber materials. Suitable materials are well known in the shaving system art, and include thermoplastic elastomers, for example, polyether-based thermoplastic elastomers (TPEs) available from Kraiburg HTP, thermoplastic urethanes (TPUs), silicones, polyether-based thermoplastic vulcanizate elastomer (TPVs) available from GLS PolyOne Corporation under the tradename Santoprene™. The elastomeric material is selected to provide a desired degree of restoring force and durability. In some implementations, the elastomer has a Durometer of less than about 90 Shore A, e.g., from about 18 to 80 Shore A, preferably from about 30 to 60 Shore A.

The return element 16 is designed such that its geometry provides an applied load as assembled that is sufficient to overcome the friction of the system at rest (pretensioned load), typically at least 5 grams, e.g., 5 to 30 grams, and a load during shaving of from about 10 to 100 grams.

The handle 12 provides a manner in which the shaving system can be manipulated and leverage can be applied to achieve desired shaving results. Referring to FIG. 4, the handle 12 can be designed to interface with the handle interface element 14 in such a manner that would enable easy removal and attachment. This could be accomplished in a number of manners, such as a mechanical locking mechanism, magnetic interaction, etc. For example, the handle interface element 14 and handle 12 can interface in the manner discussed in U.S. Ser. No. 61/651,732, filed May 25, 2012, the full disclosure of which is incorporated herein by reference.

The handle 12, blade unit 20, blade interface element 18, and handle interface element 14 can be made of any suitable material including, for example, polyethylene terephthalate (PET or PETE), high density (HD) PETE, thermoplastic polymer, polypropylene, oriented polypropylene, polyurethane, polyvinyl chloride (PVC), polytetrafluoroethylene (PTFE), polyester, high-gloss polyester, metal, synthetic rubber, natural rubber, silicone, nylon, polymer, antibacterial or antimicrobial materials, insulating, thermal, or other suitable sustainable or biodegradable materials, or any combination thereof.

Figure 12:
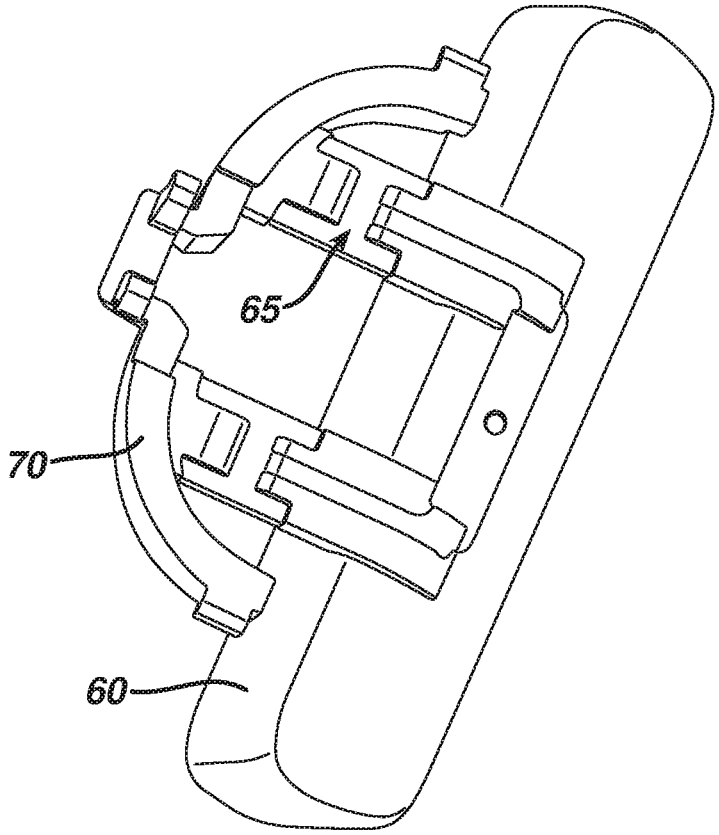
FIG. 12 is a perspective view of the handle interface element, the blade unit interface element, and the return element, taken from the opposite side.

FIGS. 9-12 show a shaving system 55 according to another embodiment. In this embodiment, the return element 65 includes a pair of elastomeric members 66A, 66B each of which is formed in the shape of an "H." As was the case in the embodiment shown in FIG. 1, the return element 65 provides an interface piece, connector and pivot all in one. The other aspects of the return element 65, the handle interface element 60, the blade unit interface element 70, the gap 71, and the blade unit 75 are the same as those in the embodiment mentioned previously. As discussed above, the elastomer may be co-molded with, or over-molded onto, the blade unit interface element and handle interface element. The flow path 141 of the elastomer is shown in FIG. 12.

Figure 14:
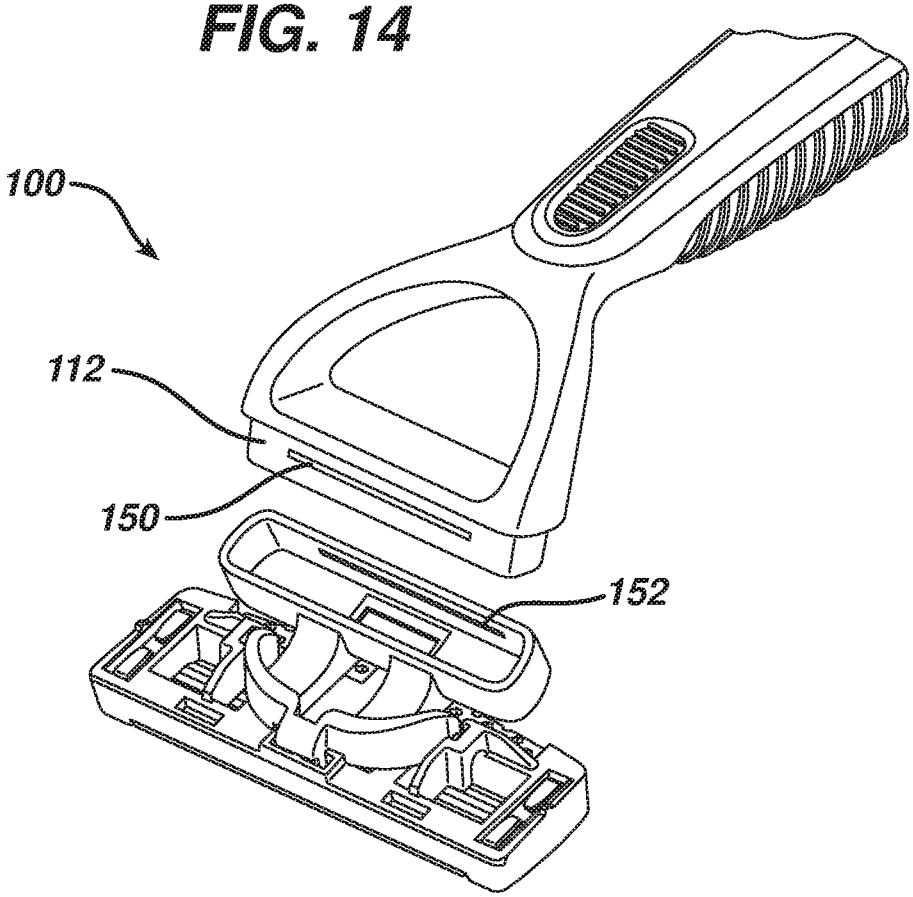
FIG. 14-14A are perspective views of an embodiment in which the shaving assembly is designed to be permanently attached to the handle.
Figure 14A:
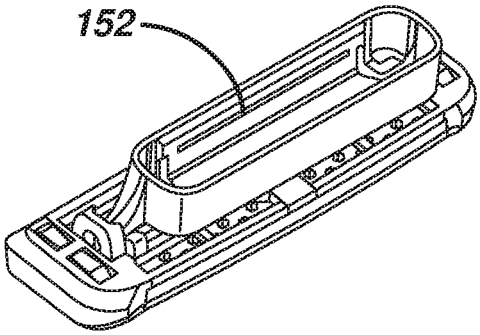

Also, while removable shaving assemblies have been discussed above, in some implementations the shaving system is designed to be disposable as a whole. In these cases, the shaving assembly is affixed to the handle in a manner that is not intended for the consumer to remove, e.g., by fixedly mounting the interface element on the distal end of the handle. This may be accomplished, for example, by engagement of corresponding mechanical locking features on the handle and interface element 144, by welding (e.g., ultrasonic welding), by molding the interface element integrally with the handle, or by any other desired mounting technique. An example of a disposable shaving system 100 is shown in FIG. 14, and the shaving assembly for such a system is shown in FIG. 14A. In this case, the handle 112 includes protrusions 150 (only one of which is shown, the other being on the opposite side of the handle), and the interface element includes corresponding locking indentations 152.

A number of embodiments have been described. Nevertheless, it will be understood that various modifications may be made without departing from the spirit and scope of the disclosure.

For example, in some embodiments through holes are provided in the portions of the interface elements over which the elastomer is molded. These holes extend in the direction of mold action, so that the elastomer will flow through the holes thereby anchoring the elastomer in place on the underlying interface elements. Alternatively, other anchoring techniques can be used.

Accordingly, other embodiments are within the scope of the following claims.

What is claimed is:

1. A replaceable shaving assembly comprising:

an interface element including a handle interface element configured to receive a distal hand of a razor handle, an arcuate blade unit interface element having attachment points, and a return element that flexibly joins the handle interface portion and the blade interface portion; and a blade unit pivotably mounted on the interface element by engagement of the attachment points on the blade interface element with complementary attachment points on the blade unit.

2. The shaving assembly of claim 1 wherein the arcuate blade unit interface element has an apex and distal ends, and the apex is spaced further away from the handle interface portion than the distal ends.

3. The shaving assembly of claim 2 wherein the attachment points on the blade unit interface element are at the distal ends of the blade unit interface element.

4. The shaving assembly of claim 3 wherein the arcuate blade unit interface element comprises one or more protrusion(s) that extend from the apex of the arcuate blade unit interface element toward the blade unit, and the blade unit includes one or more corresponding receiving bore(s) that receive the protrusions.

5. The shaving assembly of claim 4 wherein the protrusion(s) engage the bore(s) to provide a third point of attachment of the blade unit to the blade unit interface element.

6. The shaving assembly of claim 4 wherein the blade unit includes a pivot stop spaced from the receiving bore(s) and positioned to limit the pivoting of the blade unit.

7. The shaving assembly of claim 3, wherein the attachment points at the distal ends of the blade unit interface element comprise tabs, and the complementary attachment points on the blade unit comprise openings configured to receive the tabs.

8. The shaving assembly of claim 1 wherein the return element comprises one or more pairs of spaced apart rigid portions extending from the blade unit interface element and the handle unit interface element, the rigid portions facing each other in opposed space relation, and one or more flexible elastomeric return portions, each return portion being molded over the opposed ends of the rigid portions, joining the opposed ends and thus flexibly joining the handle interface portion to the blade unit interface portion.

9. The shaving assembly of claim 8 wherein the return element comprises two spaced apart elastomeric members that extend in a direction generally perpendicular to a longitudinal axis of the blade unit, and each of the elastomeric members connects a pair of the spaced apart rigid portions.

10. The shaving assembly of claim 1, wherein the return element is configured to bias the blade unit towards a rest position with respect to a pivot axis that is generally parallel to a long axis of the blade unit.

11. The shaving assembly of claim 1, wherein the return element comprises a thermoplastic elastomer or thermoplastic urethane.

12. A shaving system comprising:

a handle having a distal end and a proximal end; and an interface element interface element including a handle interface element configured to receive the distal end of the razor handle, an arcuate blade unit interface element having attachment points, and a return element that flexibly joins the handle interface portion and the blade interface element; and a blade unit pivotably mounted on the interface element by engagement of the attachment points on the blade interface element with complementary attachment points on the blade unit.

13. The shaving system of claim 12 wherein the arcuate blade unit interface element has an apex and distal ends, and the apex is spaced further away from the handle interface portion than the distal ends.

14. The shaving system of claim 13 wherein the attachment points are at the distal ends of the blade unit interface element.

15. The shaving system of claim 14 wherein the arcuate blade unit interface element comprises one or more protrusion(s) that extend from the apex of the arcuate blade unit interface element toward the blade unit, and the blade unit includes one or more corresponding receiving bore(s) that receive the protrusions.

16. The shaving system of claim 15 wherein the protrusion(s) engage the bore(s) to provide a third point of attachment of the blade unit to the blade unit interface element.

17. The shaving system of claim 15 wherein the blade unit includes a pivot stop spaced from the receiving bore(s) and positioned to limit the pivoting of the blade unit.

18. The shaving system of claim 14, wherein the attachment points at the distal ends of the blade unit interface element comprise tabs, and the complementary attachment points on the blade unit comprise receiving bores.

19. The shaving system of claim 12 wherein the return element comprises one or more pairs of spaced apart rigid portions extending from the blade unit interface element and the handle unit interface element, the rigid portions facing each other in opposed space relation, and one or more flexible elastomeric return portions, each return portion being molded over the opposed ends of the rigid portions, joining the opposed ends and thus flexibly joining the handle interface portion to the blade unit interface portion.

20. The shaving system of claim 19 wherein the return element comprises two spaced apart elastomeric members that extend in a direction generally perpendicular to a longitudinal axis of the blade unit, and each of the elastomeric members connects a pair of the spaced apart rigid portions.

21. The shaving system of claim 12, wherein the return element is configured to bias the blade unit towards a rest position with respect to a pivot axis that is generally parallel to a long axis of the blade unit.

22. The shaving system of claim 12, wherein the return element comprises a thermoplastic elastomer or thermoplastic urethane.

23. A method of shaving comprising contacting the skin with the blade unit of a shaving system comprising a handle having a distal end and a proximal end, and a replaceable shaving assembly that includes (a) an interface element interface element including a handle interface element configured to receive a distal hand of a razor handle, an arcuate blade unit interface element having attachment points, and a return element that flexibly joins the handle interface portion and the blade interface portion; and (b) a blade unit pivotably mounted on the interface element by engagement of the attachment points on the blade interface element with complementary attachment points on the blade unit.

* * * * *